US005225853A

United States Patent [19]

Kobayashi et al.

[11] Patent Number: 5,225,853

[45] Date of Patent: Jul. 6, 1993

[54] RECORDING APPARATUS WITH CONVEYOR CLEANING MECHANISM

[75] Inventors: Tohru Kobayashi, Tokyo; Tomohiro Aoki, Yokohama; Yasushi Murayama, Tokyo; Takashi Uchida, Yokohama; Masatoshi Ikkatai, Kawasaki; Tatsuo Mitomi, Yokohama; Masaharu Nemura, Yokohama; Yasuyuki Takanaka, Yokohama, all of Japan

[73] Assignee: Canon Kabushiki Kaisha, Tokyo, Japan

[21] Appl. No.: 649,719

[22] Filed: Feb. 1, 1991

[30] Foreign Application Priority Data

Feb. 2, 1990 [JP] Japan ..... 2-22201
Jul. 6, 1990 [JP] Japan ..... 2-179260

[51] Int. Cl.[5] ..... B41J 2/165
[52] U.S. Cl. ..... 346/140 R; 346/134
[58] Field of Search ..... 346/140 R, 134; 355/283, 296-302

[56] References Cited

U.S. PATENT DOCUMENTS 4,313,124 1/1982 Hara ..... 346/140 R
4,345,262 8/1982 Shirato et al. ..... 346/140 R
4,459,600 7/1984 Sato et al. ..... 346/140 R
4,463,359 7/1984 Avata et al. ..... 346/1.1
4,558,333 12/1985 Sugitani et al. ..... 346/140 R
4,568,175 2/1986 Inowa et al. ..... 355/299
4,644,372 2/1987 Hirota ..... 346/138
4,723,129 2/1988 Endo et al. ..... 346/1.1
4,740,796 4/1988 Endo et al. ..... 346/1.1
4,887,101 12/1989 Hirose et al. ..... 346/134
5,055,861 10/1991 Murayama et al. ..... 346/140 R

FOREIGN PATENT DOCUMENTS 59-123670 7/1984 Japan .
59-123760 7/1984 Japan .
59-138461 8/1984 Japan .

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

The present invention provides a recording apparatus comprising a conveyor for conveying a sheet while contacting therewith, a recording device for recording an image by discharging ink onto the sheet conveyed by the conveyor, a cleaning device for sweeping the ink adhered to the conveyor by slidingly contacting therewith, and an absorbing member for absorbing the ink adhered to the conveyor.

45 Claims, 16 Drawing Sheets

RECORDING APPARATUS WITH CONVEYOR CLEANING MECHANISM

BACKGROUND OF THE INVENTION

1. Field of the Invention

The present invention relates to a recording apparatus having the function of, for example, a facsimile, copying machine or printer, and a recording apparatus used as an output device for a composite machine having such functions or a work station.

2. Related Background Art

Non-impact recording methods have recently been noticed for the reason that the noise generated in the recording operation is so low as to be negligible. Among them, an ink jet recording method which permits a high speed recording and which can record an image on a so-called plain paper is extremely effective.

In the ink jet recording apparatus, when a recording liquid (ink) is discharged on a recording paper, the ink is often discharged on a recording paper conveying belt due to the malfunction of a paper feeding system, so that the ink is adhered to the conveying belt. Consequently, when the next recording operation is performed, the back surface of the recording paper is smeared by the ink adhered to the conveying belt. To avoid this, it is required for providing a cleaning device for cleaning the conveying belt.

An example of an ink jet recording apparatus having such cleaning device is shown in FIG. 13.

As shown, each of ink jet heads 1C, 1M, 1Y and 1BK is provided at its lower surface with ink discharge nozzles and faces a conveying belt 101 for conveying a recording paper. A conveying belt cleaner is disposed at a paper ejecting area at a downstream side of a driving roller 102 and comprises a liquid absorbing member 119 and a case 120.

The conveying belt 101 is provided with an opening for exhausting ink to outside. The cleaning of the conveying belt 101 is performed at the same time as the recording operation. The liquid absorbing member 119 acting as an ink absorber is always abutted against the belt 101 so that, during the rotation of the belt 101, the latter is always being cleaned by the liquid absorbing member 119.

In FIG. 13, the reference numeral 301 denotes a scanner portion; 302 denotes a printer portion; 303 denotes a paper supply portion; 304 denotes a belt conveying portion; 305 denotes a recording head portion; 306 denotes a recovery cap portion; and 307 denotes a fixing and ejecting portion. Since the liquid absorbing member of the cleaner is required to have the anti-wear feature, it must be made of material having both the ink absorbing feature and the anti-wear feature, with the result that the cleaner becomes expensive. Further, since the material having the best ink absorbing ability cannot be used in the cleaner, the cleaning efficiency for the belt was not satisfactory.

An image forming apparatus such as a copying machine, printer and the like, which has been widely known, is so designed that the recording paper is fed from a paper supply portion such as a cassette and is conveyed to an ejecting portion through an image forming portion. In this case, the recording paper must be always controlled at a given timing from the supply thereof to the ejection thereof. Particularly, since the timing from the supply of the recording paper to the image formation thereon relates to a position of the image recorded on the recording paper, the accurate conveyance of the recording paper is requested. Further, if the conveying speed of the recording paper during the image formation is not constant, the discrepancy in the magnification of the image occurs, with the result that the image will be enlarged or contracted. In particular, in an image forming apparatus having a plurality of image forming portions arranged side by side, the discrepancy between the images recorded at various recording portions will occur. This causes the discrepancy in colors and/or unevenness in color in a color image recording apparatus, thus affecting a bad influence upon the formation of the color image. To prevent such inconvenience, the conveying speed of the recording paper must be constant by accurately transmitting the conveying force from a conveying means to the recording paper.

SUMMARY OF THE INVENTION

An object of the present invention is to provide a recording apparatus having the highly effective belt cleaning function.

Another object of the present invention is to provide a recording apparatus wherein the back surface of a recording paper is not smeared by ink during the recording operation.

Another object of the present invention is to provide an image forming apparatus which can adequately apply an electrical attraction force to a conveying means for conveying a recording paper, can always convey the recording paper correctly without smearing the latter with the ink and can form a sharp image.

DETAILED DESCRIPTION OF THE PREFERRED EMBODIMENTS

The present invention will now be explained in connection with embodiments thereof with reference to the accompanying drawings.

Figure 1:
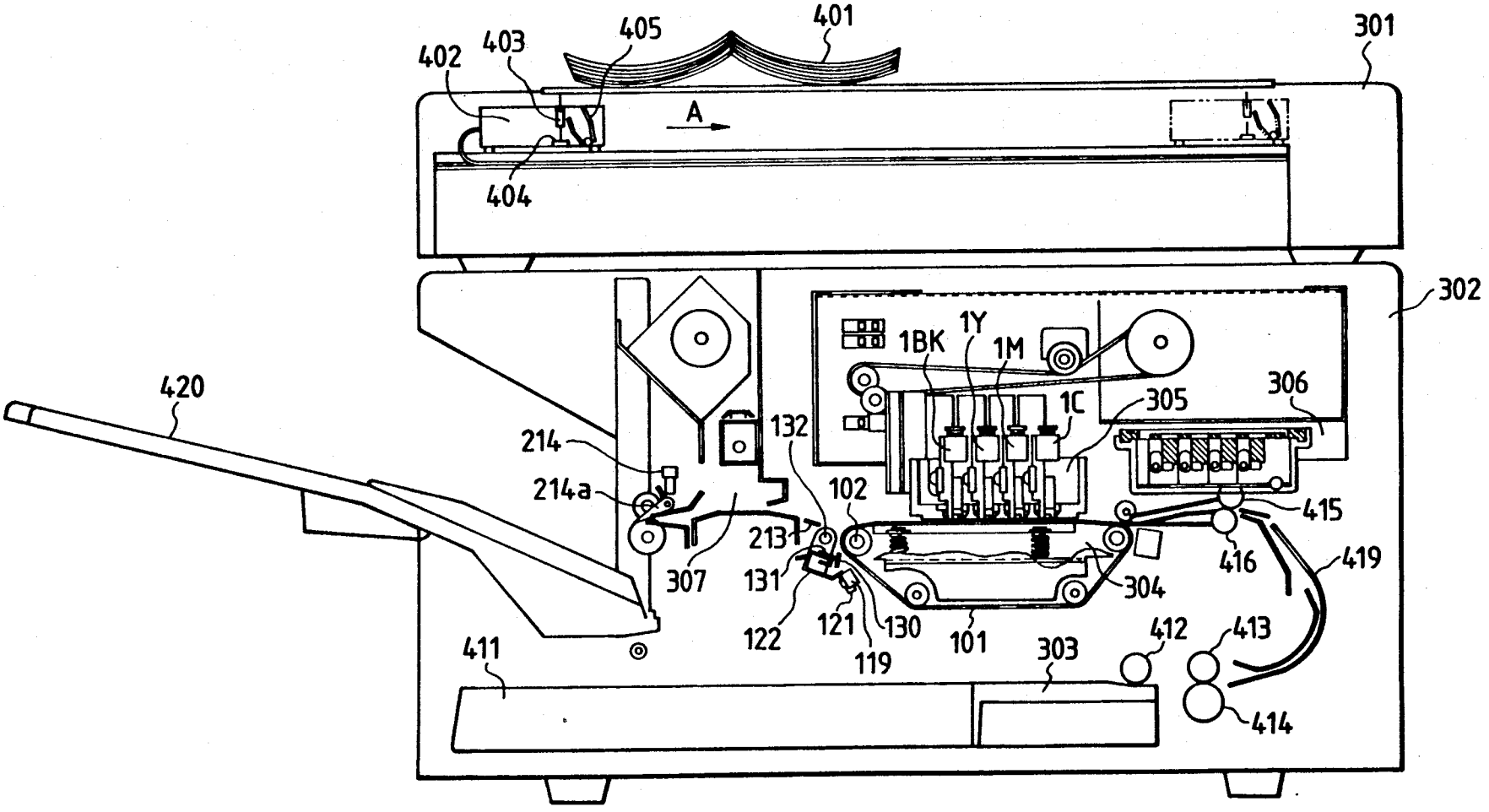
FIG. 1 is an elevational sectional view of an ink jet recording apparatus according to a first embodiment of the present invention.
Figure 13:
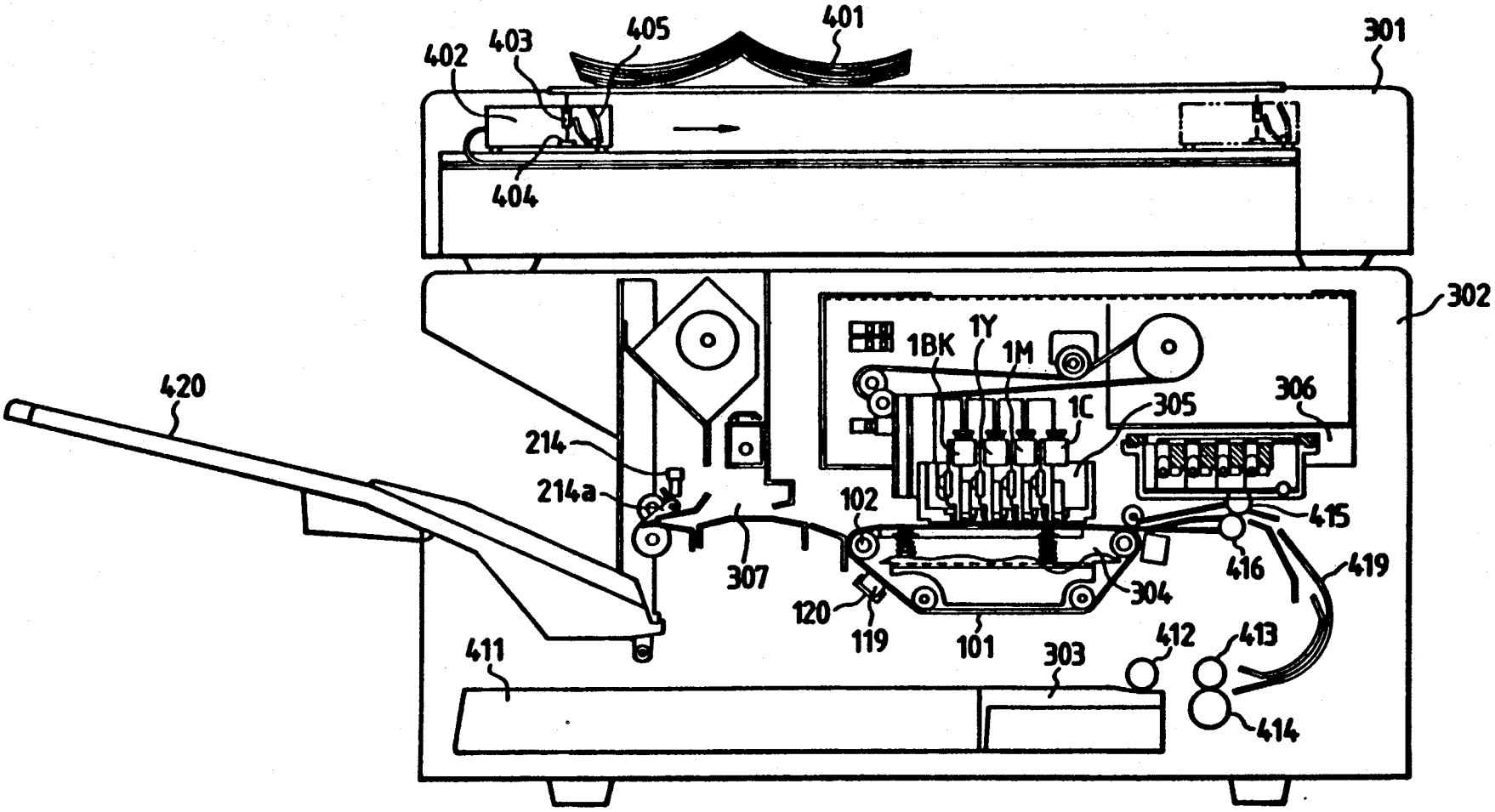
FIG. 13 PRIOR ART
FIG. 13 is an elevational sectional view of a recording apparatus having a belt cleaning device.

First of all, an ink jet recording apparatus according to a first embodiment of the present invention will be described with reference to FIG. 1 showing an elevational sectional view of such apparatus. In FIG. 1, the same elements as those an shown in FIG. 13 will be denoted by the same reference numerals used in FIG. 13.

In FIG. 1, the reference numeral 301 denotes a scanner portion for reading information on an original 401 and for converting the information into an electric signal. A signal based on the electric signal converted in the scanner portion 301 is sent to a recording head portion 305 of a printer portion 302 as a drive signal. Incidentally, in the scanner portion 301, the original 401 is scanned by an original scanning unit 402. The original scanning unit 402 includes a rod array lens 403, a color separation line sensor of same magnification type (color image sensor) 404 and an exposure means 405 therein.

When at least the original scanning unit 402 is shifted for scanning in a direction shown by the arrow A to read the image on the original 401, an exposure lamp of the exposure means 405 incorporated in the original scanning unit 402 is energized, and the reflection light reflected from the original is guided by the rod array lens 403 to be gathered onto the color separation line sensor of same magnification type (referred to as "reading sensor" hereinafter) 404 for reading the color information, where the color image information of the original is read for every color, and the read data are converted into electrical digital signals. The digital signals are outputted to the printer portion 302. Each recording head for each color receives a drive signal based on the corresponding digital signal and discharges the liquid from its discharge openings. Each recording head includes electrical/thermal converters, by which the thermal energy is applied to ink liquid to create the film boiling therein.

In FIG. 1, the reference numeral 411 denotes a recording medium cassette; 412 denotes a pick-up roller; 413, 414 denote recording medium conveying rollers; 415, 416 denote regist rollers; 417, 418, 419 denote conveying guides; 420 denotes an ejector tray; 214 denotes a sheet discharge sensor; and 214*a* denotes ejector rollers.

The sheets of recording paper (recording medium) contained in a sheet supply portion 303 are supplied one by one to a belt conveying portion 304 as required. As the recording paper is passing through the belt conveying portion 304, the image is recorded on the recording paper by means of the recording head portion 305, and, thereafter, the recording paper is sent to the tray 420 through a fixing and ejecting portion 307.

Incidentally, a recovery cap portion 306 acting as a recovery system serves to maintain a condition that the recording head portion 305 can always perform the recording operation. Next, each of the parts of the apparatus will be fully explained.

Figure 2:
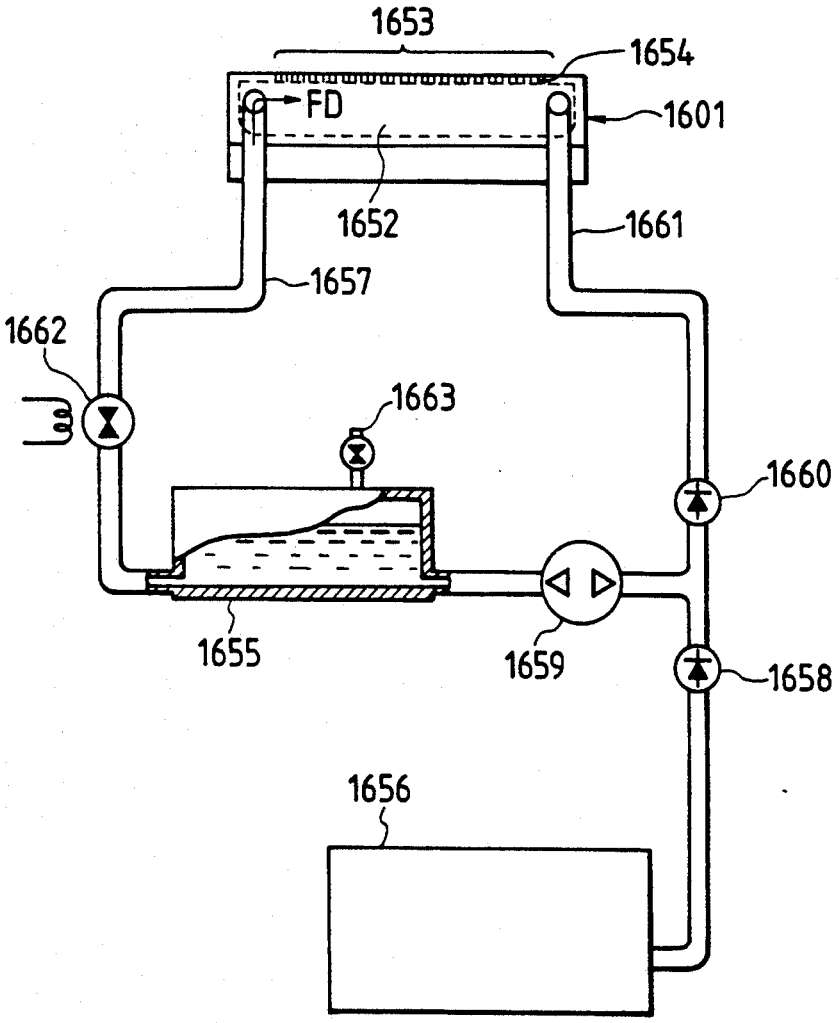
FIG. 2 is a schematic constructual view showing a relation between an ink supply system and a recording head of the recording apparatus of FIG. 1.

First of all, the ink supply to the lengthened recording head of the full-line type used in this embodiment will be described with reference to FIG. 2 which is a constructional view showing the relation between the lengthened recording head and the ink supply system. In FIG. 2, the reference numeral 1601 denotes the recording head; 1652 denotes a common liquid chamber formed in the recording head 1601; and 1653 denotes liquid discharge openings arranged on a recording liquid discharge surface 1654.

In the illustrated embodiment, the discharge openings 1653 are disposed in correspondence to the whole recordable width of the recording paper to be treated, and, by selectively energizing the heat generating elements disposed in liquid passages (not shown) communicating with the corresponding discharge openings 1653, the recording liquid is discharged from the associated discharge openings, so that the recording can be effected without the scanning movement of the recording head itself.

The reference numeral 1655 denotes a recording liquid supply tank for supplying the liquid to the recording head 1601; and 1656 denotes a main tank for replenishing the recording liquid to the supply tank 1655. The recording liquid is supplied from the supply tank 1655 to the common liquid chamber 1652 of the recording head 1601 via a supply tube 1657. When the replenishment of the liquid is required, the recording liquid is replenished to the supply tank 1655 from the main tank 1656 via a one-way replenishing rectifier valve 1658 by the action of a recovery pump 1659.

The reference numeral 1660 denotes a one-way recovery rectifier valve used in the recovery operation effected for recovering the discharge ability of the recording head 1601; 1661 denotes a circulating tube in which the recovery rectifier valve 1660 is disposed; 1662 denotes a solenoid valve disposed in the supply tube 1657; and 1663 denotes an air vent valve for the supply tank.

In the recording head 1601, the recording liquid supply system and the recovery system constituted as mentioned above, during the recording operation, the solenoid valve 1662 is held in an open condition, whereby the recording liquid is supplied, by its own weight, to the common liquid chamber 1652 from the supply tank 1655 and then is directed from the common liquid chamber 1652 to the discharge openings 1653 via the liquid passages (not shown).

On the other hand, during the recovery operation effected to remove the bubbles remaining in the common liquid chamber 1652 and in the supply system and to cool the recording head 1601, the recovery pump 1659 is activated to forcibly send the recording liquid to the common liquid chamber 1652 via the circulating tube 1661, thus returning the recording liquid from the common liquid chamber 1652 to the supply tank 1655 via the supply tube 1657, whereby the recording liquid is circulated.

Furthermore, during the initial liquid filling operation to the liquid passages and the like, the recording liquid is forcibly sent to the common liquid chamber 1652 via the circulating tube 1661 by means of the recovery pump 1659 while closing the solenoid valve 1662, thus discharging the recording liquid together with the bubbles from the discharge openings.

Normally, in such a recording head the recording liquid is left therein when it is not used. Thus, by providing a capping means having a cap engageable with the discharge surface of the recording head, capping of the recording head-with the cap while the recording operation is stopped is possible. In this way, the recording head is sealingly protected from the environmental atmosphere, and at the same time, by filling an air space between the head and the cap with the vapor of ink, the saturated vapor pressure of ink is created in such space, whereby the vaporization of the liquid in the liquid passages, the increase in the viscosity of ink and the drying of ink in the liquid passages are prevented.

However, under the low humidity condition and/or when the recording operation is stopped for a long time, even if prevention of the vaporization of ink in the liquid passages is attempted by capping the recording head, the increase in the viscosity of ink sometimes occurs; as a result, it is feared that the non-discharge of ink or unstable discharge of ink from the discharge openings cannot be prevented when the recording operation is started again.

Regarding such a problem, as mentioned above, an ink circulating and pressurizing means for discharging the ink from all of the discharge openings of the recording head by forcibly circulating and pressurizing the ink under the activation of the recovery pump 1659 is also utilized. Incidentally, if the non-discharge (of ink) condition is slight or not serious, the ink discharge operation same as the normal ink discharge operation for recording the image on the recording paper may be effected by energizing all of the energy generating means of the head. However, this ink discharge operation does not relate to the image formation, it is referred to as "idle discharge" hereinafter in this specification.

As mentioned above, when the ink is solidified in the discharge openings or in the liquid passages due to the drying of ink leading to the increase in the viscosity of ink because of the long non-recording condition, it is possible to recover the recording head to the print permitting condition by forcibly circulating and pressurizing the ink; whereas, when the solidification of ink is slight because of the short non-recording condition, it is also possible to recover the recording head to the print permitting condition by performing the idle discharge operation.

Next, the recording medium which is preferably used with the recording apparatus according to the illustrated embodiment will be explained.

In the ink jet recording process, since the recording liquid such as "ink" is discharged as liquid droplets flying toward the recording medium such as a paper to form the image on the recording medium, it is required that the ink is not excessively spread on the recording paper to prevent the formation of a faded image.

Further, the recording medium preferably has features so that the ink adhered to the recording medium can quickly be absorbed by the latter, and particularly the ink flow and ink spread are minimized even when inks of different colors are adhered at the same position for a short time, and the spread of the printed dot can be suppressed so as not to lose the sharpness of the image.

In the ink jet recording apparatus according to the illustrated embodiment, as the recording paper meeting the requirements of the above-mentioned features, it is preferable to use a recording paper obtained by coating a base paper with a material (for example, pulverized silicic acid) satisfying the above-mentioned features, as disclosed in the Japanese Patent Appln. Laid-Open No. 56-148583. In this case, the ink is adhered to the coating layer of the recording paper.

Accordingly, in the illustrated embodiment, in order to obtain an image with more high quality, the coated recording paper is used when the recording is effected with three or more ink colors and the non-coated recording paper (recording paper having no coating layer) is used when the recording is effected with one or two ink colors. However, it should be noted that the coated recording paper can be used when the recording is effected with one or two ink colors, or various known recording papers may be used as the recording medium in the present invention.

Figure 3:
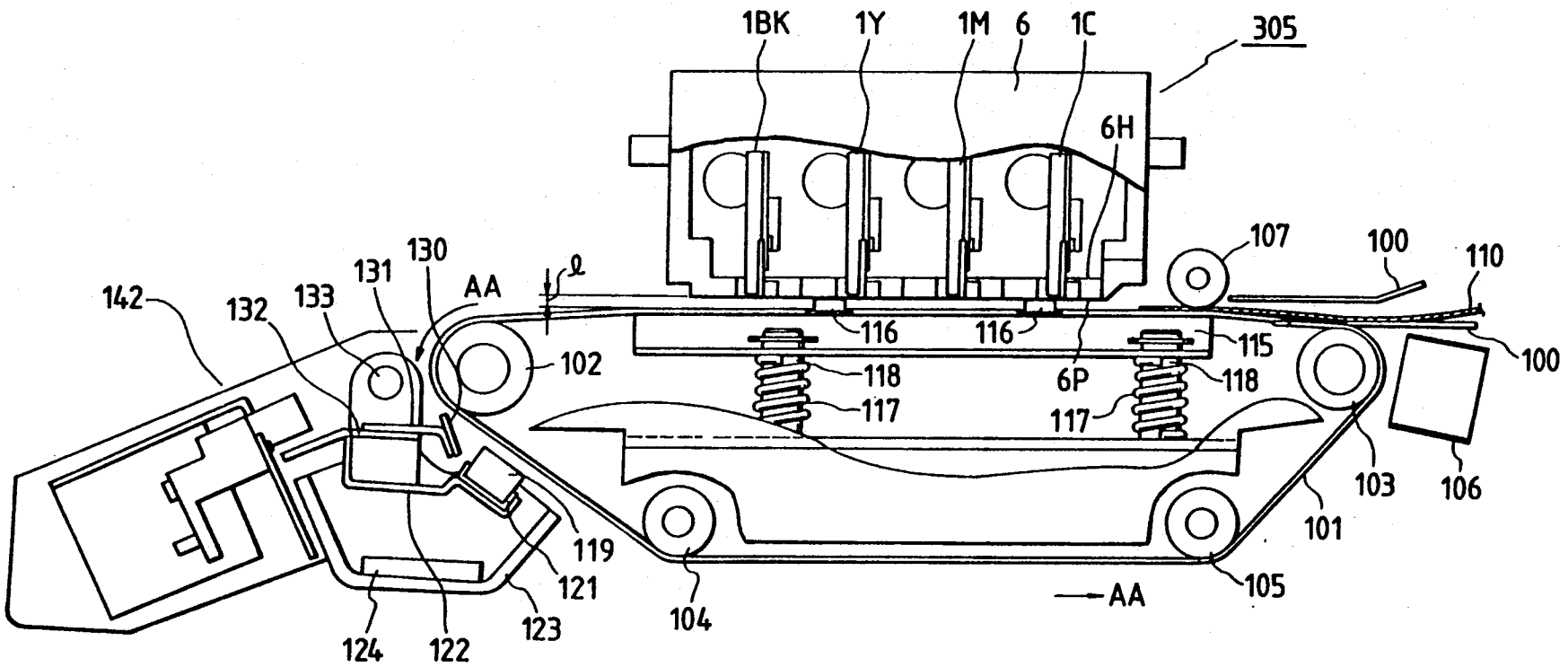
FIG. 3 is a sectional view of a main portion of a belt cleaning device of the apparatus of FIG. 1.
Figure 4:
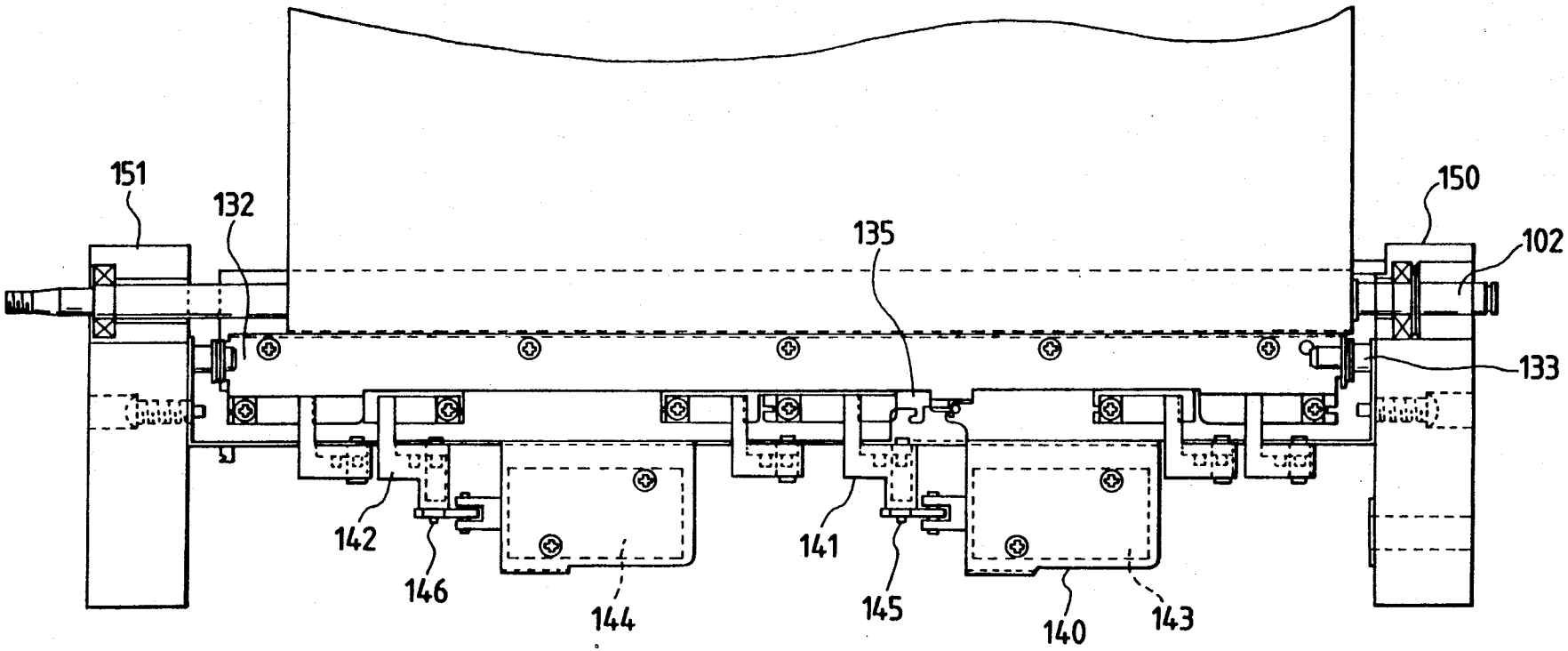
FIG. 4 is a plan view of a main portion of a belt cleaning device of the apparatus of FIG. 1.

FIGS. 3 and 4 schematically show a cleaner portion of the ink jet recording apparatus according to the illustrated embodiment. FIG. 3 is a elevational sectional view of a belt cleaning device of the recording apparatus shown in FIG. 1. FIG. 4, is a plan view of the belt cleaning device.

In FIG. 3, a recording paper 110 is conveyed at a constant speed from the right to the left by means of a conveying belt 101. However, when the recording paper 110 does not reach the ejector tray 420 (FIG. 1) due to any abnormity during the conveyance of the recording paper, the jamming of the paper is indicated or displayed by the sheet discharging sensor 214, and at the same time the recording operation is temporarily interrupted. After an operator remedies the paper jamming condition, the recording apparatus is re-started. In this case, before the re-start of the recording apparatus, the belt cleaning operation is carried out by activating the cleaning device automatically or manually.

Next, main parts of the apparatus according to the present invention will be described with reference to FIGS. 3 and 4. A plate-shaped or chip-shaped blade 130 made of polyurethane rubber is attached to an attachment plate 131. The attachment plate 131 is fixedly mounted on an angle member 132 rotatably mounted on a pivot pin 133 extending in parallel with a driving roller 102. An absorbing member 119 is fixed to a case 121 which is in turn fixedly mounted on an attachment angle member 122 rotatably mounted on the pivot pin 133.

A plunger angle member 140 to which an electromagnetic plunger 143 for engaging and disengaging the blade 130 with respect to the belt 101 and an electromagnetic plunger 144 for engaging and disengaging the absorbing member 119 with respect to the belt 101 are attached to front and rear arms 150 and 151 to which the driving roller 102 is mounted. Further, a driving arm 141 for transmitting a stroke movement of the plunger 143 to the angle member 132 and a driving arm 142 for transmitting a stroke movement of the plunger 144 to the attachment angle member 122 are rotatably mounted on support pins 145 and 146 fixed to the angle member 140, respectively. Tension springs 134 and 135 are connected between the angle member 132 and the angle member 140, and between the angle member 122 and the angle member 140, respectively, so that the blade 130 and the absorbing member 119 are separated from the belt 101, respectively, during the non-attraction of the plungers 143 and 144.

In FIG. 3, the reference numerals 103, 104, 105 denote conveying rollers; 6 denotes a head holder; 100 denotes a guide; 106 denotes a charger; 121 denotes an opening; 107 denotes a pinch roller; 6H denotes head holding seal members; 6P denotes recording surfaces of the head holding seal members; 115 denotes a platen; 116 denotes spacers for creating a clearance l between the heads and the platen; 117 denotes springs for urging the platen against the head holder 6 through the spacers 116; and 118 denotes support shafts around which the springs 117 are disposed.

The blade 130 is pressed against the conveying belt 101 so that an edge of the blade is abutted against the belt 101 through a whole width n of the belt. In this condition, the belt 101 is rotated, with the result that the ink remaining on the belt is transferred to the blade 130, thus removing the ink from the belt 101. Further, since the blade 130 is urged against the belt, the former is pressed against the latter at a portion of the belt which is difficult to be deformed (a portion of the belt supported by the driving roller 102 in the illustrated embodiment). A blade attaching surface is directed substantially in a vertical direction so that the ink swept by the blade 130 is quickly dropped down out of the blade 130.

Further, waste ink is collected into an ink receiver 123. In order to prevent the interior of the apparatus from being smeared, an absorber 124 is disposed in the ink receiver 123, thus holding the ink in the absorber. Although most of the ink is naturally dried and vaporized, if a large amount of ink is removed from the belt, the excessive ink is directed from the ink receiver to an additional ink tank (not shown). The absorbing member 119 is made of continuous porous material (such as a sponge member).

Figure 5:
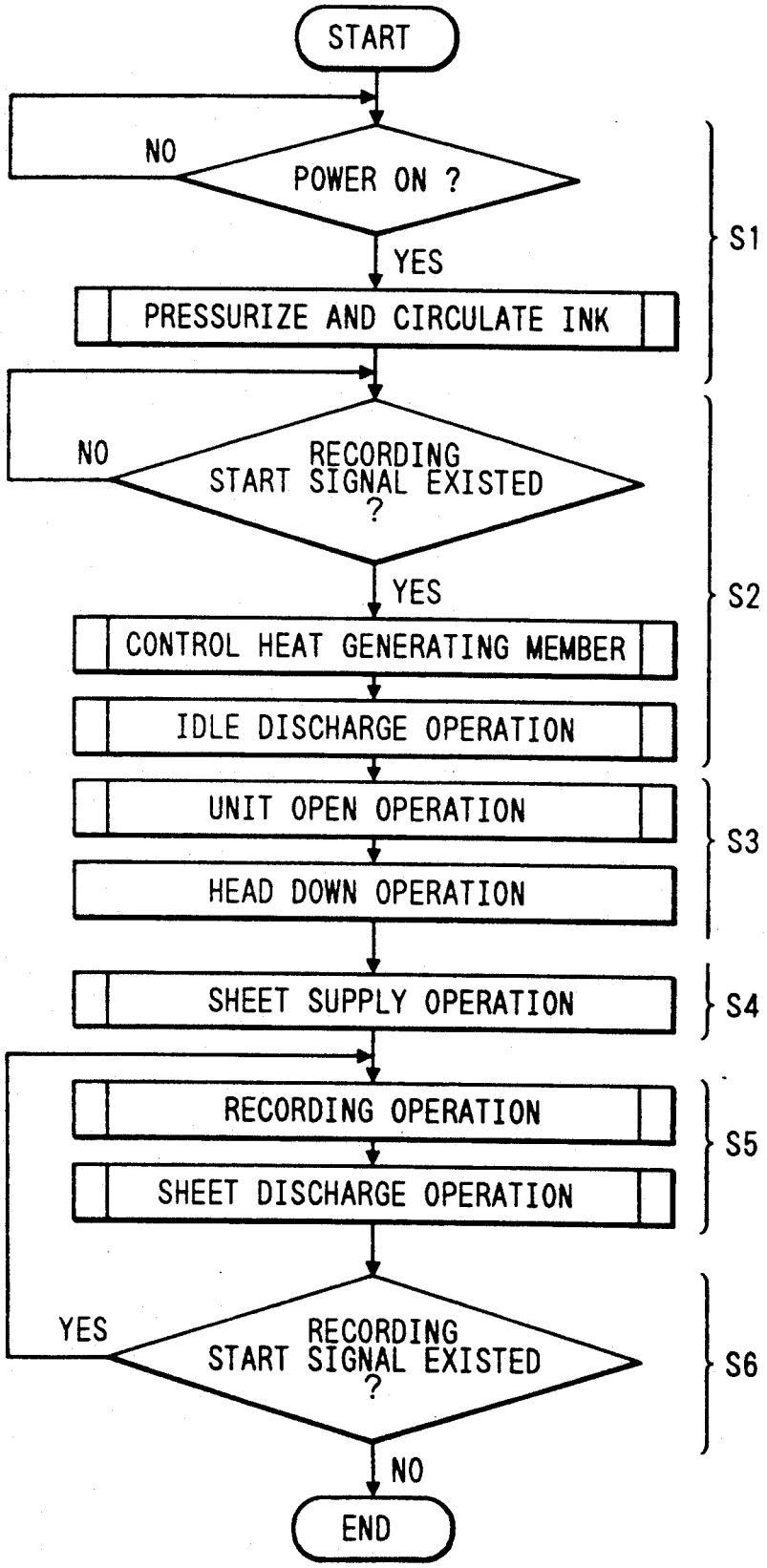
FIG. 5 is a flow chart showing a normal sequence regarding the recording apparatus of FIG. 1.
Figure 14:
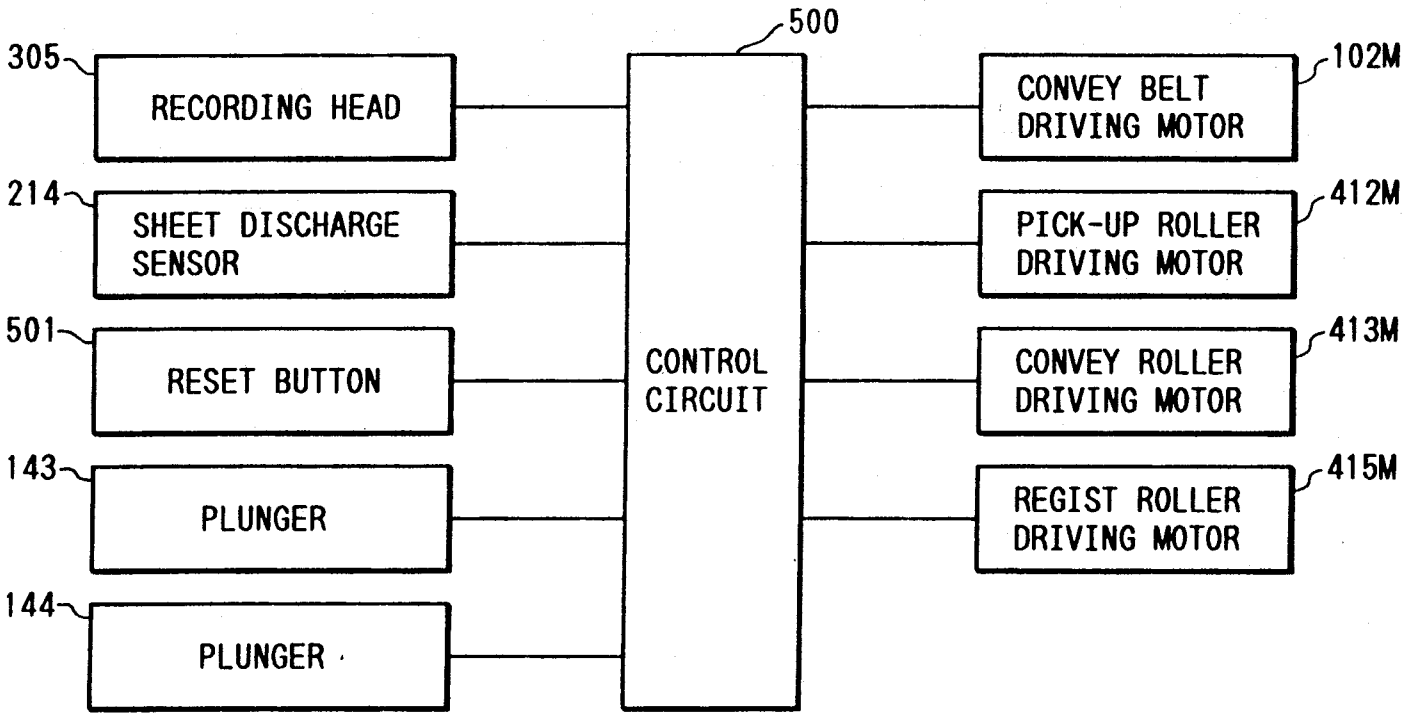
FIG. 14 is a control block diagram regarding the apparatuses according to various embodiments.

Next, a sequence of the image recording after the activation of a power source will be explained with reference to a flow chart of FIG. 5 and a block diagram shown in FIG. 14.

In a step S1, by performing an ink pressurization and circulation operation, it is possible to prevent the non-discharge of ink due to the solidification of ink because of the increase in the viscosity of ink (by vaporizing the solvent in the ink, i.e., by the drying of the ink) and due to the formation of bubbles under a condition that the recording apparatus is not used for a long time before the activation of the power source. Note that the ink pressurize and circulation operation is effected only immediately after the power source is turned ON.

For example, under the high temperature and high humidity conditions or when the apparatus is kept in the non-operative condition for a long time after the activation of the power source, in consideration of a problem regarding the occurrence of the bubbles and the solidification of ink as mentioned above, the ink pressurize circulation operation is carried out every predetermined time periods set by a timer means and the like.

Figure 6:
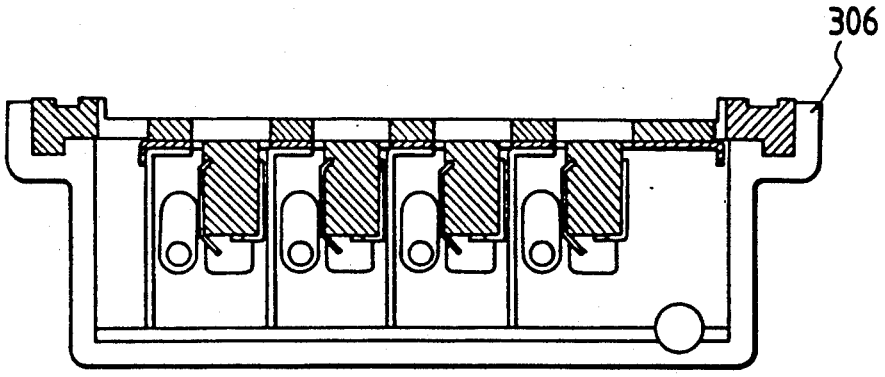
FIG. 6 is a sectional view showing a capping condition of the recording heads of the recording apparatus of FIG. 1.

Now, so long as the recording start signal is not inputted, the recovery cap portion 306 is maintained in the capping condition shown in FIG. 6. When the recording start signal is inputted, the sequence goes to a step S2. On the basis of signal emitted from a humidity sensor (not shown) arranged in the vicinity of the recording head portion shown in FIG. 1, by increasing or decreasing the number of pulses for the idle discharge, it is possible to prevent the non-discharge solely by the idle discharge operation.

Then, the sequence goes to a step S3, where the recovery cap portion 306 is separated from the recording head portion 305 and the latter is lowered to face the recording paper conveying portion. The recording head portion is stopped when a predetermined distance between the conveying belt and the recording head is established.

Next, the sequence goes to a step S4, where a paper supply operation is effected. Then, the sequence goes to a step S5, where a pick-up roller driving motor 412M is activated to supply the recording paper from the cassette 411 by means of the pick-up roller 412, whereby the recording paper is sent to a nip between the regist rollers 415, 416 through the conveying rollers 413, 414 driven by a conveying roller driving motor 413M and the guide 419.

After the recording paper is abutted against the nip between the paired regist rollers 415, 416, it is still conveyed by the conveying rollers 413, 414 for a while, so that a loop is formed in the recording paper at the guide area 419. This action is the registration normally performed in the electrophotographic copying machine and the like, for correcting the skew-feed of the recording paper and for performing the registration of a leading end of the recording paper.

Then, the regist rollers 415, 416 are rotated by the motor 415M to feed the recording paper onto the conveying belt 101 through guides 417, 418. In this case, on the basis of a signal for starting the rotation of the regist rollers 415, 416, a signal for starting the scanning of the original and the printing start signal for the recording heads 1C, 1M, 1Y, 1BK are emitted. The recording paper conveyed on the conveying belt 101 is gradually adhered to the surface of the conveying belt 101 from the leading end of the paper by the electrostatic attraction force, and, as the recording paper is passed under the recording heads 1C, 1M, 1Y, 1BK, the printing or recording is effected regarding the recording paper by the aforementioned means, with keeping the proper gap between the recording paper and the recording heads.

Thereafter, the recording paper is sent to the fixing and ejecting portion 307. In this case, when the recording paper is transferred from the conveying belt 101 to a guide 213, the recording paper is naturally separated from the conveying belt by the resiliency of the recording paper itself by selecting the small diameter of the driving roller 102.

The diameter of the driving roller 102 is so selected that the shifting distance of the conveying belt 101 given by one revolution of the driving roller equals a distance between the discharge openings of the first recording head 1C and those of the fourth recording head 1BK.

This selection is effected in consideration of the fact that, if the driving roller 102 is somewhat eccentric, the discrepancy in the registration of the images will occur. It is ideal that the shifting distance of the conveying belt 101 given by one revolution of the driving roller should correspond to a distance between the discharge openings of the two adjacent recording heads. However, since the minimum diameter of the driving roller 102 is limited to some extent in consideration of the mechanical strength, the shifting distance of the belt will inevitably become larger. Thus, since triple the distance is required between the four heads, the apparatus becomes large sized. Therefore, the distance between first and fourth heads which are spaced furthest from each other (which distance includes the most factors for the discrepancy in the images) is considered as the head distance for the full-color image.

However, the head distance may correspond to the distance between the first and third heads, as well as the distance between the two adjacent heads, and, accordingly, is not limited to the aforementioned one. But, the above-mentioned diameter of the driving roller and the head distance should be under some consideration.

Now, it is not required to provide a fixing process for the recording paper sent to the fixing and ejecting portion 307. However, when a non-coated paper called as a plain paper is used in a so-called electrophotographic copying machine, the fixing means is required. That is to say, since, when the non-coated paper is used, the fixing speed of the ink to the recording paper cannot be obtained within the process speed (conveying speed), a heating means is provided to increase the fixing speed.

When the recording paper is detected by the sheet discharge sensor 214 within a predetermined time period after the regist rollers have been rotated, it is judged that the ejecting operation has been completed, with the result that the sequence goes to a step S6, where the apparatus is waiting for the recording start signal for the next page. If this signal exists, the recording operation is repeated; whereas, if such signal does not exist, the image recording sequence is finished. The reference numeral 214*a* denotes an actuator rocked by the recording paper to drive the sheet discharge sensor (photosensor) 214.

Figure 7:
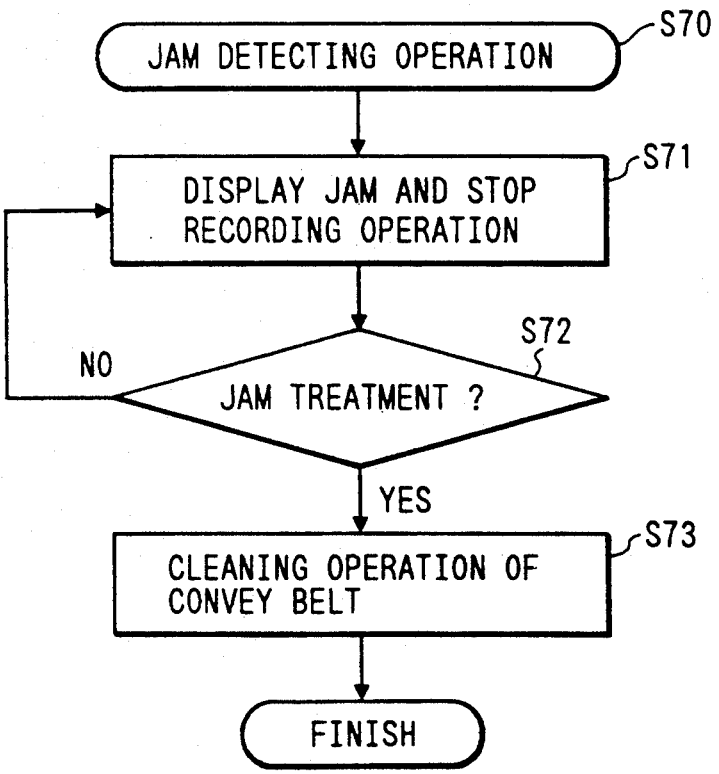
FIG. 7 is a flow chart showing a sequence of a jam detecting operation in the apparatus of FIG. 1.
Figure 8:
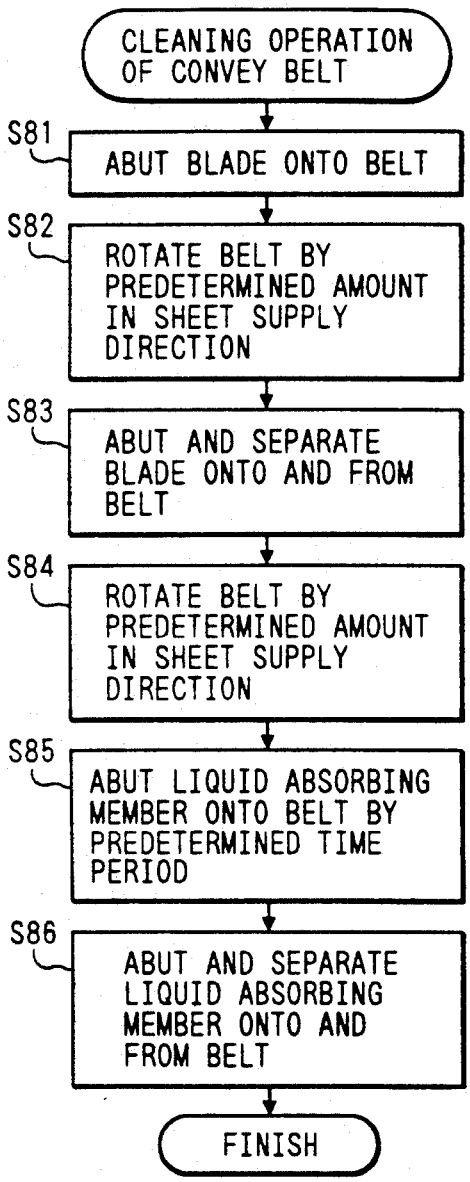
FIG. 8 is a flow chart showing a sequence of a belt cleaning operation in the apparatus of FIG. 1.
Figure 9:
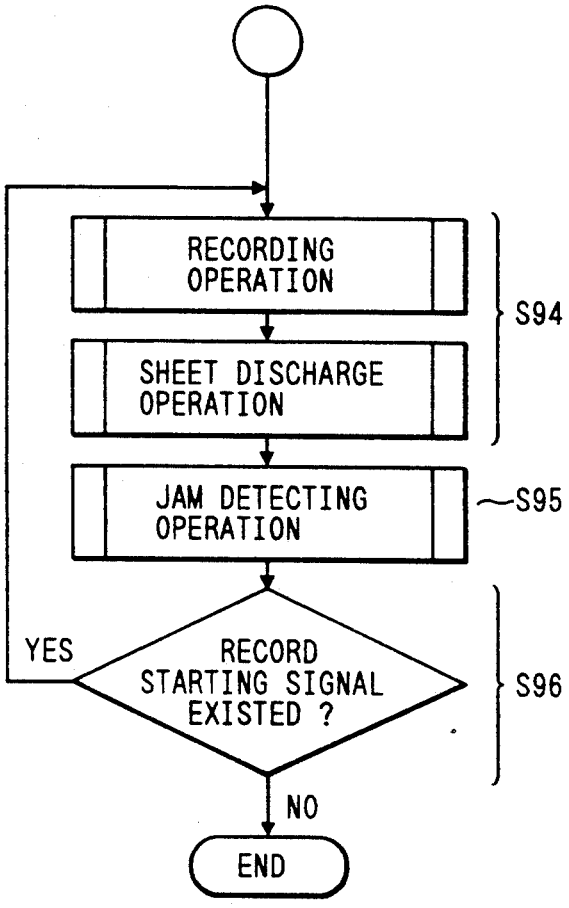
FIG. 9 is a flow chart showing a whole operational sequence of the apparatus of FIG. 1.

Next, a sequence of a belt cleaning operation will be explained with reference to flow charts shown in FIGS. 7 and 8. Although the normal sequence of the recording operation has been described above, if the recording paper is jammed during the normal recording sequence, the cleaning sequence according to the present invention is executed as shown in steps S94, S95, S96 of FIG. 9.

In FIG. 1, even when the recording sheet does not reach the sheet discharge sensor 214, since the ink is discharged from the recording head 1 in response to the recording start signal, the ink will often be discharged not on the recording paper but on the conveying belt until the recording operation is interrupted by the sheet discharge sensor 214.

In the recording apparatus according to the invention, when the jamming of the recording paper is detected, the recording operation is stopped in a step S71. In steps S72 and S73, after the jamming condition is remedied, when an operator depresses a reset button 501, a sequence mode for cleaning the belt is established. Incidentally, in a step S70 of FIG. 7, a control circuit 500 judges the fact that the jamming of the paper occurs, when the sheet discharge sensor 214 does not detect the recording paper within a first predetermined time period after the initiation of the rotation of the regist rollers 415, 416 or when the detection of the recording paper by means of the sheet discharge sensor 214 is not completed within a second predetermined time period.

Now, the cleaning operation will be described in accordance with the flow chart of FIG. 8. First of all, in a step S81, the plunger 143 is activated to urge the blade 130 against the belt 101. Thereafter, in a step S82, the belt is shifted so that a belt portion to which the ink has been adhered can pass through the blade 130, thus removing most of ink from the belt by means of the blade 130. Then, when the blade is stopped after the cleaning, in a step S83, the plunger 143 is deenergized to separate the blade 130 from the belt.

Then, in a step S84, the belt 101 is shifted by a distance between the blade 130 and the absorbing member 119 (between positions at which they contact the belt). This is the reason why the residual ink remaining on the belt 101 after sweeping action of the blade edge is cleaned or removed by the absorbing member.

Thereafter, in a step S85, the absorbing member 119 is urged against the belt by the plunger 144 for an appropriate time period, and then the plunger 144 is turned OFF to separate the absorbing member from the belt in a step S86. Now, the cleaning sequence for the belt is finished, and the sequence returns to a sequence established at the end of the paper ejecting operation.

In consequence of the mechanisms of the recording apparatus, the following is more preferable. That is to say, if the driving force for the belt 101 has less reserve when the blade 130 is urged against the belt, the cleaning ability of the blade 130 for removing the ink from the belt 101 will often be reduced. In this case, by simultaneously contacting the blade 130 and the absorbing member 119 with the belt, it is possible improve the cleaning of the ink.

Figure 10:
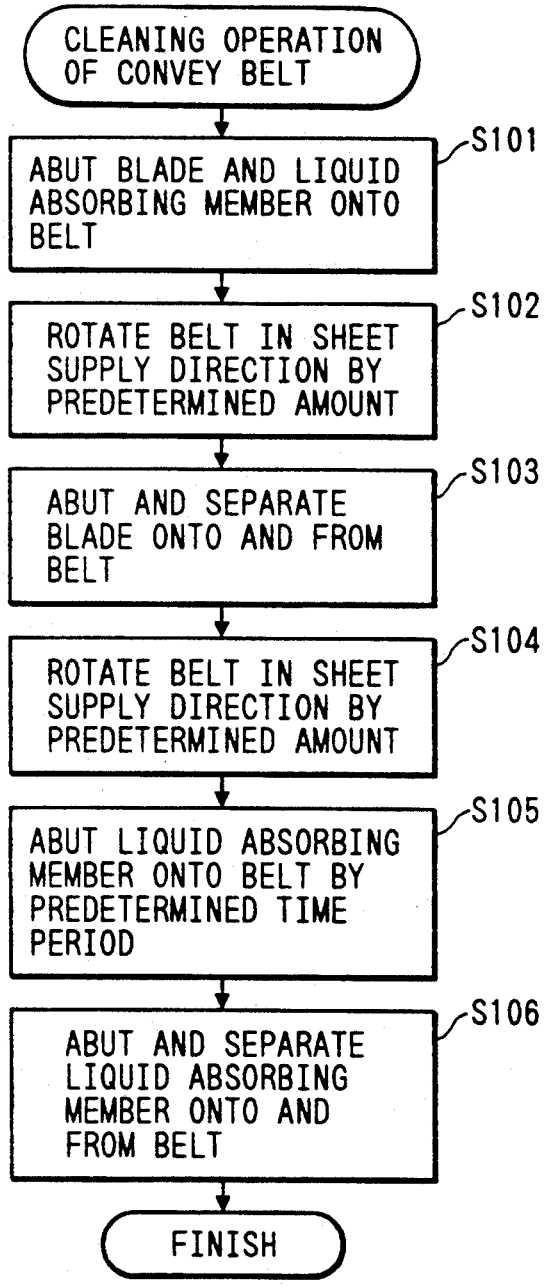
FIG. 10 is a flow chart showing another sequence of a belt cleaning operation in the apparatus of FIG. 1.

FIG. 10 shows such cleaning sequence. First of all, in a step S101, the blade 130 and the absorbing member 119 are simultaneously urged against the belt 101, and then the belt to which the ink is adhered is shifted, thus removing the ink from the belt by means of both the blade 130 and the absorbing member 119. Then, the blade 130 alone is separated from the belt, and the belt is shifted by a distance between the blade 130 and the absorbing member 119 (between positions at which they contact the belt). After the absorbing member 119 is urged against the belt for an appropriate time period, the absorbing member is separated from the belt. Now, the cleaning sequence for the belt is finished, and the sequence returns to the sequence of the step S96 in FIG. 9.

Figure 11:
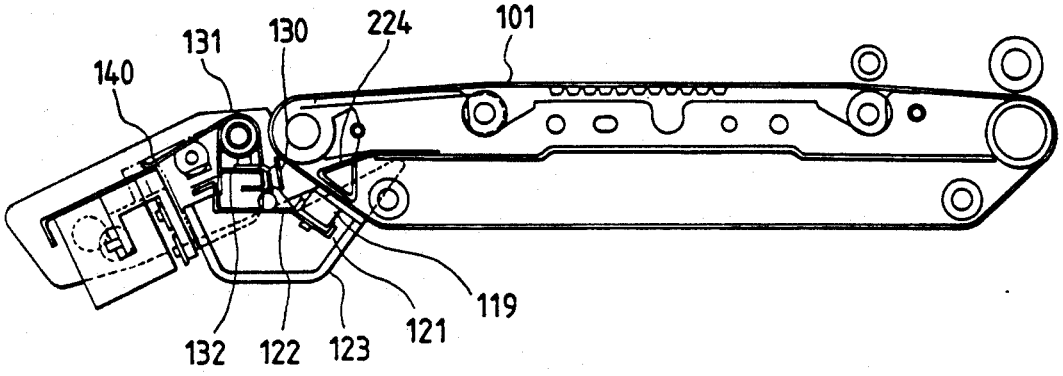
FIG. 11 is a sectional view of a main portion of a belt cleaning device of a recording apparatus according to a second embodiment of the present invention.

Next, a second embodiment of the present invention is shown in FIG. 11.

In this embodiment, a pressure plate 224 fixed with respect to a conveying unit is disposed inside the conveying belt 101 in confronting relation to the absorbing member 119 with the interposition of the belt. With this arrangement, it is possible to increase the force by which the absorbing member 119 is urged against the belt, thus providing the advantage of the present invention. Further, in the illustrated embodiment, it is possible to obtain the predetermined pressure by the smaller deforming amount of the absorbing member than the case of no provision of the pressure plate 224. Incidentally, the other constructions are the same as those of the previous embodiment.

Figure 12:
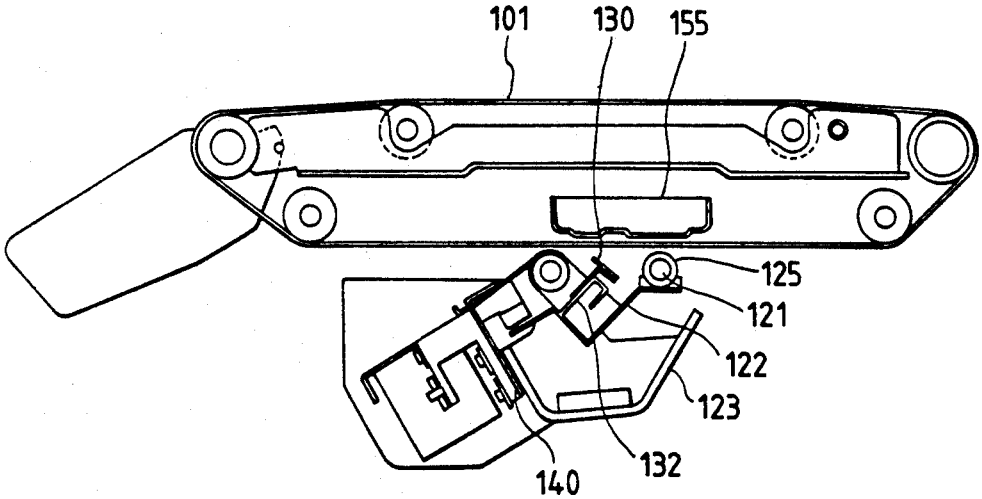
FIG. 12 is a sectional view of a main portion of a belt cleaning device of a recording apparatus according to a third embodiment of the present invention.

A third embodiment of the present invention is shown in FIG. 12.

In this embodiment, the cleaning device is disposed in confronting relation to a lower horizontal run of the conveying belt 101. And, a roller-type absorbing member 125 comprising a roller 121 having an absorbing layer at its peripheral surface is arranged at a downstream side of the blade 130. A pressure plate 155 is disposed at the inside of the conveying belt in such a manner that both the blade 130 and the roller-type absorbing member 125 can abutted against the pressure plate.

While the roller-type absorbing member 125 is being urged against the belt after the belt is swept by the blade 130 or at the same time when the blade is urged against the belt, the conveying belt 101 is rotated. Also with this arrangement, the same advantage can be obtained.

Next, a fourth embodiment of the present invention will be described with reference to FIG. 15.

Figure 15:
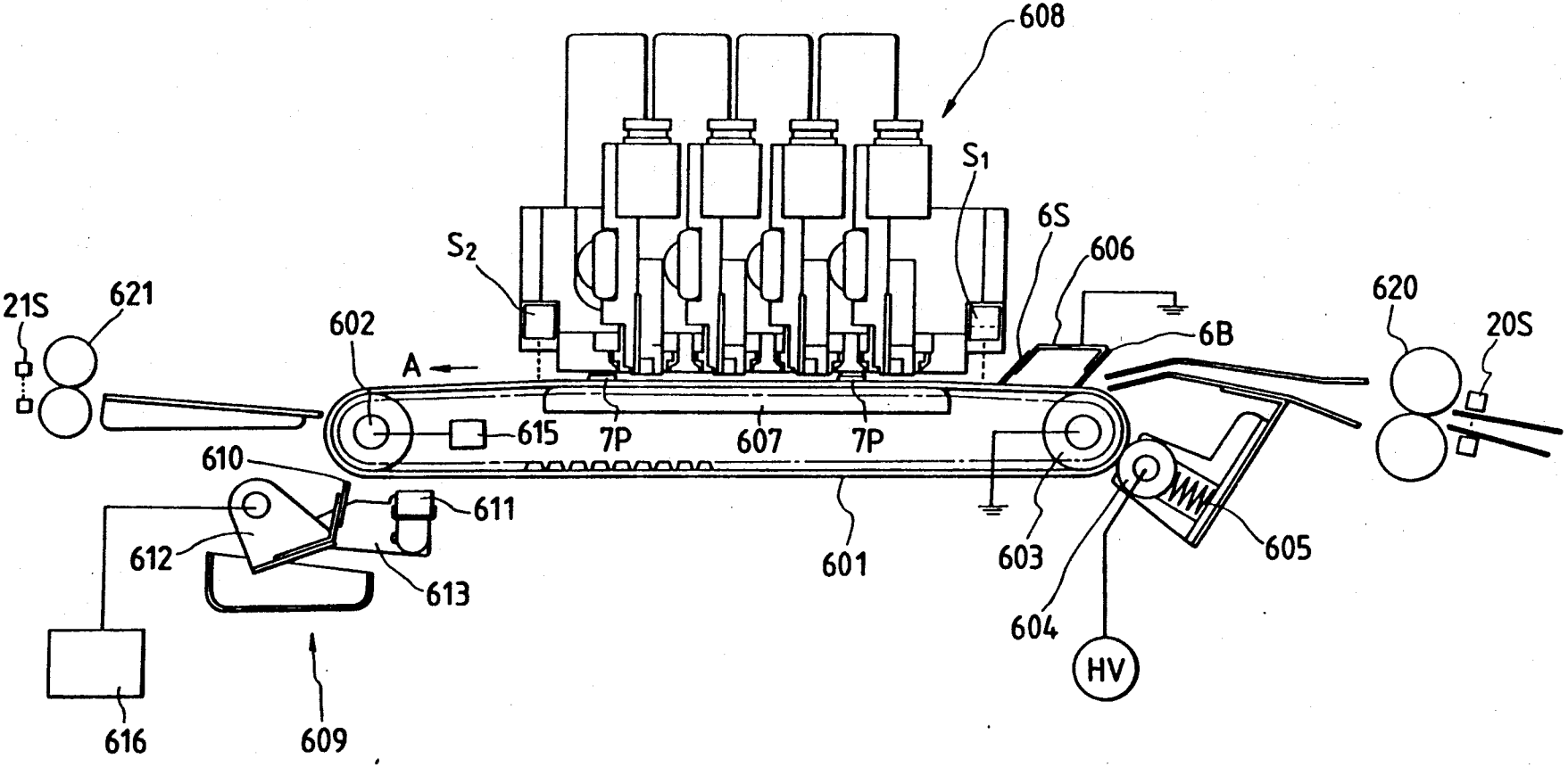
FIG. 15 is a schematic enlarged sectional view of a main portion of a recording apparatus according to a fourth embodiment of the present invention.

In FIG. 15, the reference numeral 620 denotes regist rollers disposed in a paper supply path. In the vicinity of the regist rollers 620, there is arranged a sensor 20S for detecting the recording paper. On the other hand, ejecting rollers 621 and a sensor 21S for detecting the recording paper are arranged in a paper ejecting path. Between the regist rollers 620 and the ejecting rollers 621, there is disposed a conveying means (conveying belt) 601 for conveying the recording paper in a direction shown by the arrow A. A recording means (recording head portion) 608 is disposed above the conveying belt 601.

Preferably, the conveying belt 601 includes an insulation layer having the volume resistance of $10^{14}\Omega\cdot$cm. The conveying belt comprises an endless belt supported between a driving roller 602 and a driven roller 603. A driving motor (not shown) is connected to the driving roller 602 to rotate the latter in the direction A in FIG. 15. The reference numeral 604 denotes a charging means (charging roller) electrically connected to a high voltage source HV, which roller is urged against the conveying belt by means of springs 605 arranged at both ends of this roller. The driven roller 603 is electrically grounded, and the conveying belt 601 is sandwiched or pinched between the driven roller 603 and the charging roller 604. By applying the charging roller 604 with a high voltage of about 1–2 KV, the electrical potential is maintained on the surface of the conveying belt 601.

An attracting member 606 is electrically grounded. The attracting member serves to apply the charges onto the recording paper being conveyed, and, in the illustrated embodiment, for example, it is constituted by an electro-conductive brush 6B and an resin sheet 6S, the free ends of which contact the surface of the conveying belt 601.

A platen 607 disposed at the inside of the conveying belt 601 serves to keep a portion of the conveying belt opposed to the recording head portion 608 in a flat condition, and a given distance is maintained between the platen 607 and the recording head portion 608 by pins 7P disposed on the platen.

A cleaning means (belt cleaning portion) 609 is provided with a blade 610 and an absorbing member 611, both of which are independently supported by supports 612 and 613, respectively. The supports 612 and 613 have rotary driving means for urging the blade and the absorbing member, respectively.

A control means 616 is associated with the rotary driving means, so that the blade 610 supported by the support 612 is first urged against the conveying belt 601 and then is separated from the belt and thereafter the absorbing member 611 supported by the support 613 is urged against the conveying belt 601. Explaining the operation of the blade and the absorbing member more in detail, first of all, while the conveying belt 601 is rotated, the blade 610 is urged against the belt. After a predetermined time period has elapsed, the belt is stopped and the blade 610 is separated from the belt. In this case, since an ink trace remains along the blade edges, the belt portion having the ink trace thereon is shifted to the absorbing member 611 and then the belt 601 is stopped there again. Then, the absorbing member 611 is urged against the belt to absorb the ink remaining along the ink trace. After a predetermined time period has elapsed, the absorbing member 611 is separated from the belt, thus finishing the cleaning operation.

Incidentally, a control means 615 is associated with the driving motor (not shown) connected to the driving roller 602 for the conveying belt 601, so that the conveying belt is rotated at least one revolution before the recording paper is conveyed, so as to fully charge the conveying belt 601 by means of the charging roller 604.

Figure 16:
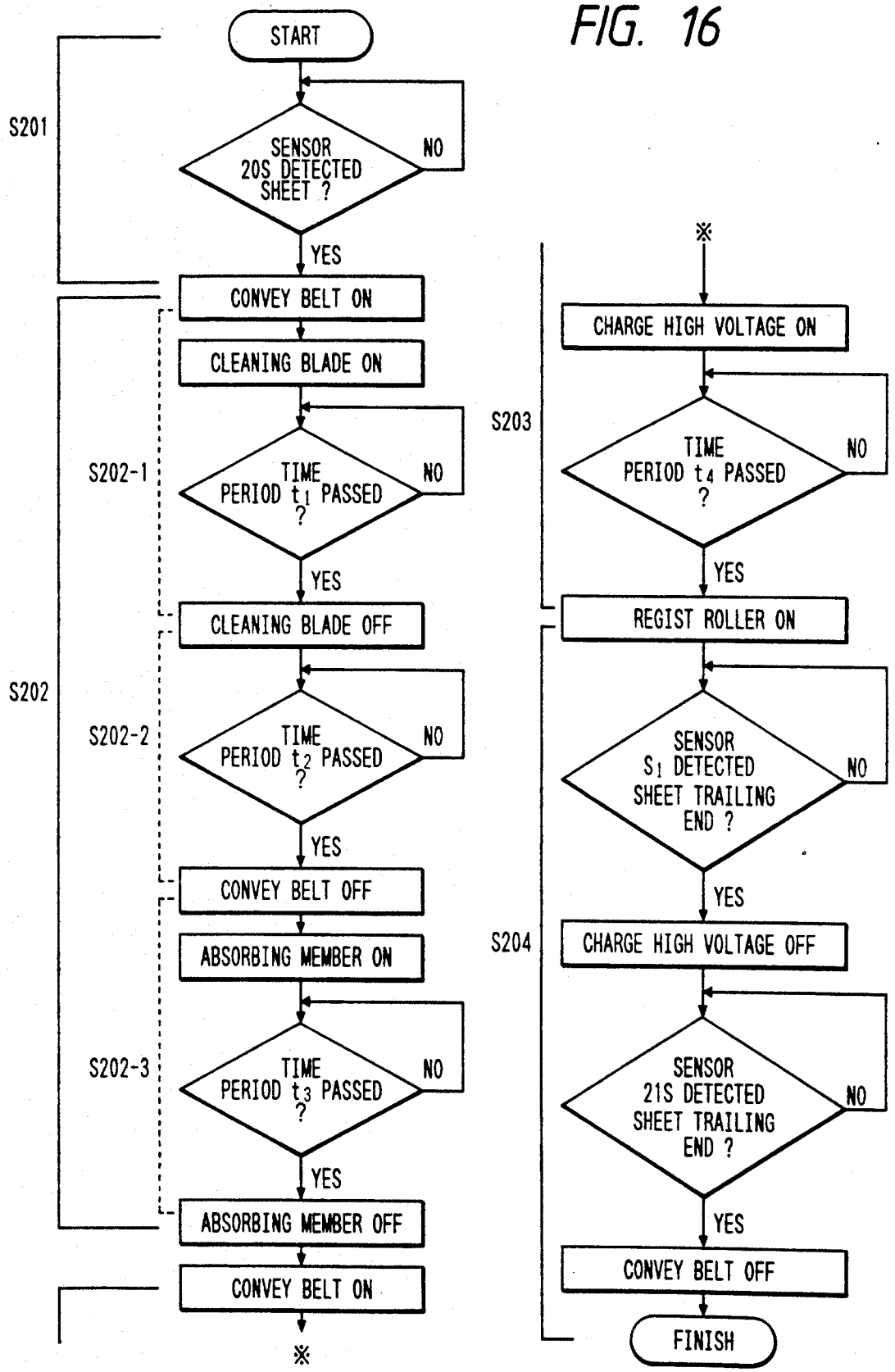
FIG. 16 is a flow chart showing an operation of the apparatus of FIG. 15.

Next, an operation of the apparatus according to the illustrated embodiment will be explained with reference to sequences shown in FIGS. 15 and 16 to further clarify the present invention.

First of all, when the recording sequence is initiated by depressing a copy button, the recording paper is supplied from the paper supply portion (not shown) to reach the regist rollers 620. In this case, the sensor 20S disposed immediately before the regist rollers 620 detects the recording paper, thus starting the cleaning sequence (step S201).

The cleaning sequence is shown in a step S202. First of all, the conveying belt 601 is started to rotate, and at the same time the blade 610 is urged against the belt. After a predetermined time period $t_1$ has elapsed, the blade 610 is separated from the belt. The time period $t_1$ has a duration slightly longer than a time period for one revolution of the conveying belt 601 (step S202-1). Incidentally, when the blade 610 is separated from the belt, the latter may continue to rotate or may be temporarily stopped.

Then, after the predetermined time period $t_2$ has elapsed from the separation of the blade 610, the conveying belt 610 is stopped. If the conveying belt 601 is stopped when the blade 610 is separated from the belt, the latter is rotated again until a predetermined time period $t_2$ has elapsed. This is the reason why, since the ink trace remains along the blade edges on the conveying belt, the position of the ink trace is registered with the absorbing member 611. Accordingly, the time period $t_2$ corresponds a time duration until the ink trace formed on the belt upon separation of the blade 610 reaches the absorbing member 611 (step S202-2). Then, the absorbing member 611 is urged against the conveying belt 601. After a predetermined time period $t_3$ has been elapsed, the absorbing member 611 is separated from the belt, thus completing the cleaning operation. The time period $t_3$ corresponds to a time duration until the absorbing member 611 adequately absorbs the ink in the ink trace on the belt and is previously set by the control means 616 (step S202-3).

Figure 17:
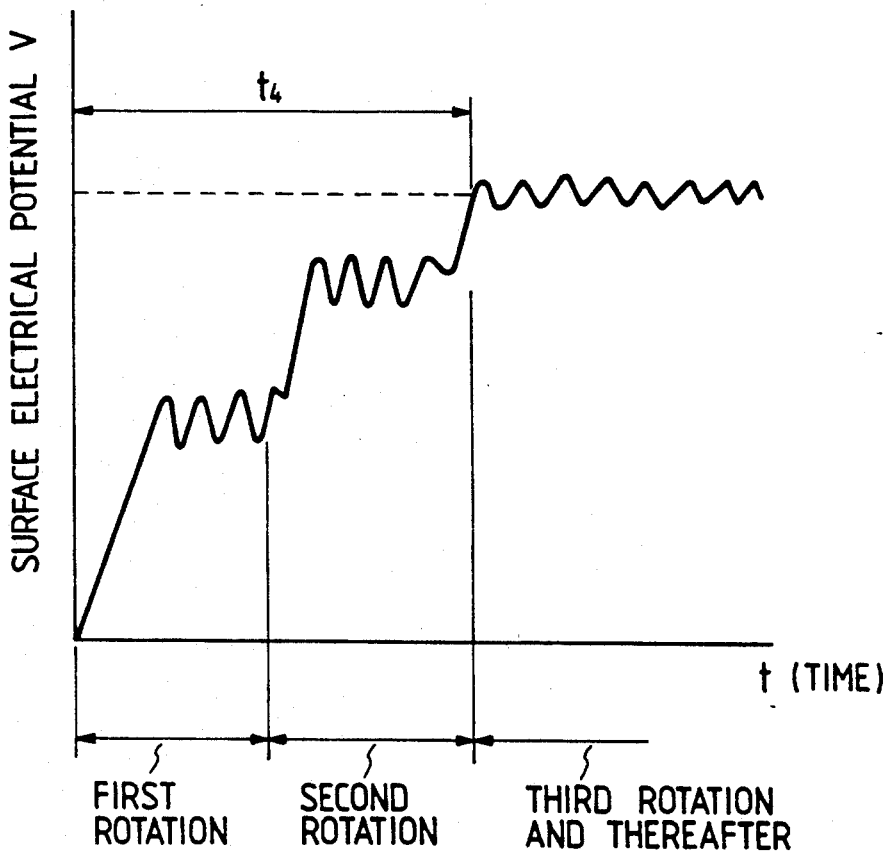
FIG. 17 is a graph showing an example of the change in the surface electrical potential of a conveying belt (conveying means)

When the above-mentioned cleaning sequence is finished, the conveying belt 601 is started again, and at the same time the high voltage source HV connected to the charging roller 604 is turned ON. After a predetermined time period $t_4$ has elapsed, the regist rollers 620 are rotated to convey the recording paper onto the conveying belt 601. In this case, as shown in FIG. 17, the time period $t_4$ corresponds to a time duration until the surface potential of the conveying belt 601 reaches a set value V previously set by the control means 615. In the illustrated embodiment, although the time period $t_4$ is so set that, during this time period, the whole surface of the conveying belt 601 passes through the charging roller 604 two times, such time period may be so set that the whole belt surface can pass through the charging roller once, or three or more times. Incidentally, the more the passing times, the more the charged voltage is made uniform. This is referred as "pre-charging" (step S203).

Now, the recording paper is sent by the regist rollers 620 to be passed between the attracting member 606 and the conveying belt 601. In this case, the conveying belt 601 is charged by the charging roller 604 at least once, and the timing of activation of the regist rollers 620 is controlled so that the belt portion further passed through the charging roller contacts the recording paper. In this way, by causing the polarization in the recording paper due to the charging of the conveying belt 601, the recording paper is attracted to the conveying belt. Further, the charges are applied to the recording paper by the attracting member 606, thus further strongly adhering the recording paper to the belt.

Then, the recording paper is conveyed while being recorded on by the recording head portion 608. When a sensor $s_1$ detects a trailing end of the recording paper in case of one page mode or when the sensor detects a trailing end of the last recording paper in case of the multi-page mode, the high voltage source HV is turned OFF, and, when the recording paper is further conveyed by the ejecting rollers 621, the trailing end of the recording paper (or the last recording paper) is detected by the sensor 21S, thus stopping the conveying belt 601 and the operations of other recording portions, whereby the image forming sequence is finished (step S204).

Incidentally, in the illustrated embodiment, while an example that the cleaning sequence in the step S202 is started after the sensor 20S detects the recording paper was explained, if the performance of the cleaning sequence requires a long time duration so that the recording paper reaches the regist rollers 620 before the cleaning sequence has not yet been finished, the cleaning sequence may be started on the start of the recording apparatus, so that the cleaning sequence is finished while maintaining the recording paper in a waiting condition at the regist rollers 620, and thereafter the step S203 may be carried out.

Figure 18:
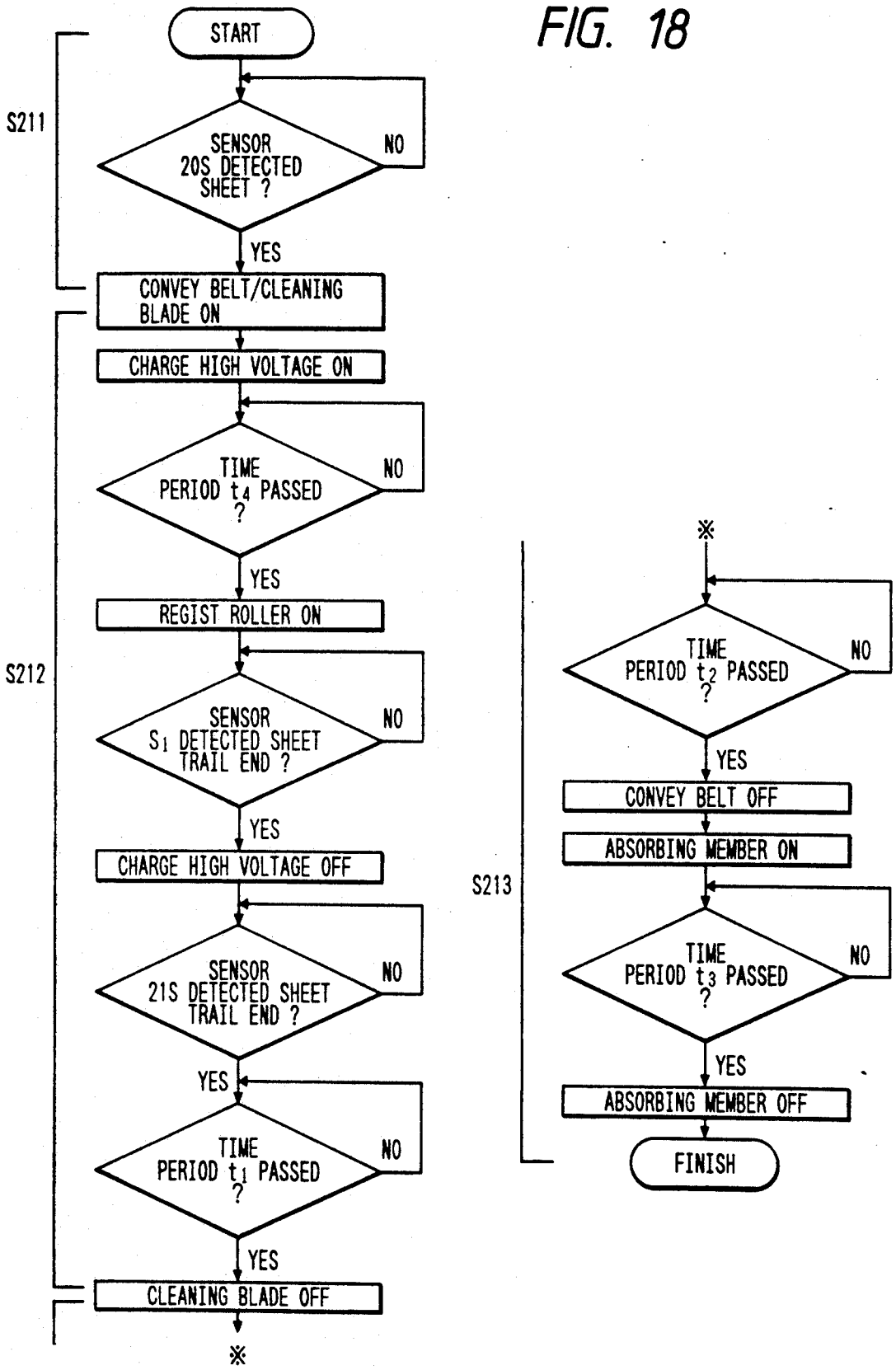
FIG. 18 is a flow chart showing an operation of a recording apparatus according to fifth embodiment present invention.

FIG. 18 shows a fifth embodiment of the present invention. Incidentally, since the constructural elements in this embodiment is substantially similar to those of the fourth embodiment shown in FIG. 15, a detailed arrangement is not shown in the drawings, but the operation thereof is merely described with reference to a flow chart of FIG. 18.

In this embodiment, the cleaning by means of the blade is carried out during a series of sequences from the charging to the recording. First of all, the recording sequence is started by depressing the copy button, the same operation as that in the step S201 of the fourth embodiment is effected (step S211). Now, the conveying belt 601 starts to rotate, and at the same time the blade 610 is urged against the conveying belt. Further, at the same time, the high voltage source is also turned ON. Then, the sequence performs steps same as the steps S203 and S204 of the fourth embodiment. In this case, in the step S204, after the sensor 21S detects the trailing end of the recording paper, the step S202-2 of the cleaning sequence is executed (step S212). Thereafter, the sequence performs steps S202-2 and S202-3 and is finished (step S213).

In the illustrated embodiment, since the cleaning blade 610 always contacts the conveying belt 601 during the recording operation by means of the recording head portion 608, it is less effective in view of the conveying accuracy; however, advantages, such as the cleaning time before the recording operation can be shortened and the first copy time can also be reduced, are obtained.

Figure 19:
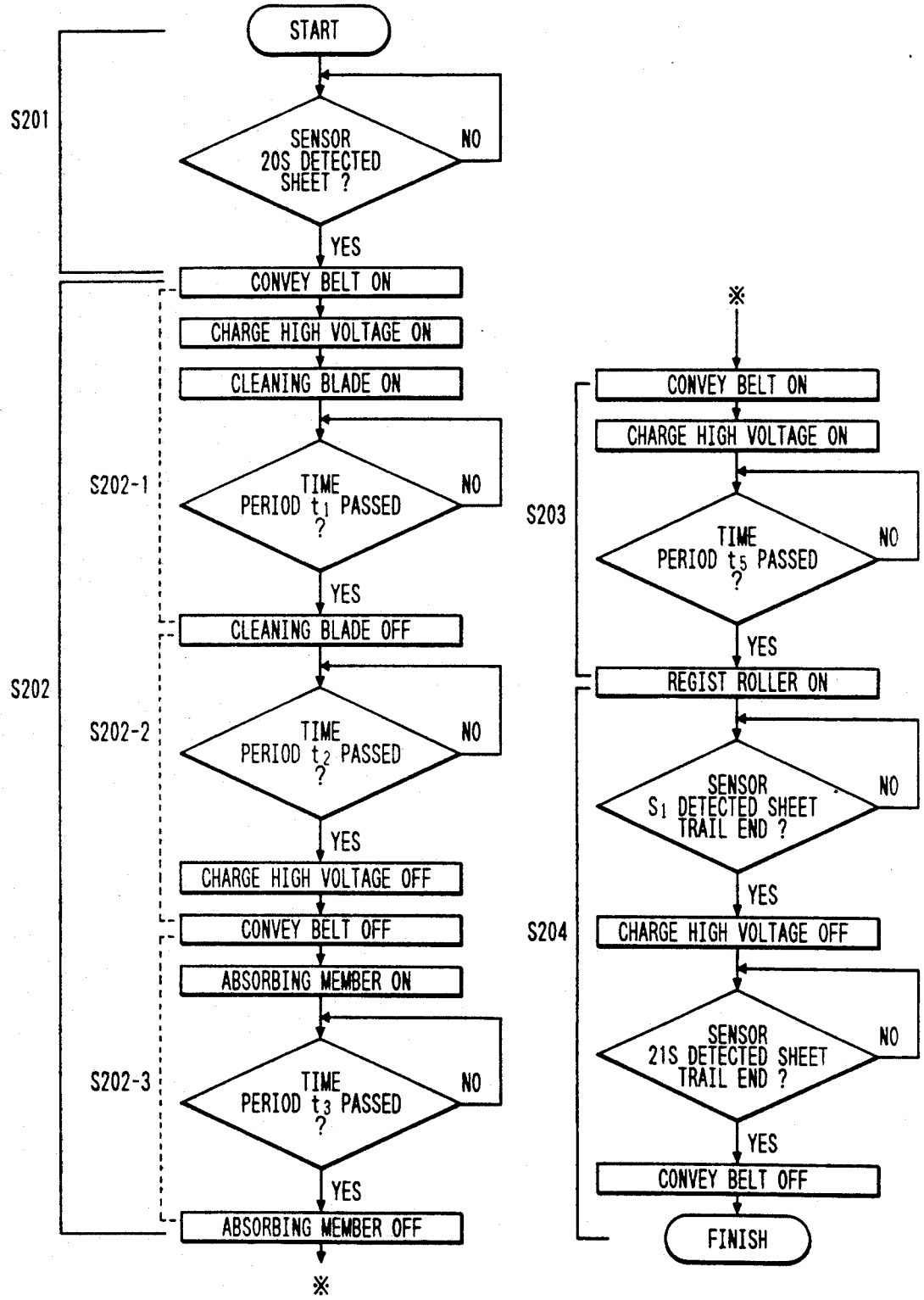
FIG. 19 is a chart showing an operation of a recording apparatus according to sixth embodiment of the present invention.

FIG. 19 shows a sixth embodiment of the present invention. Also, this embodiment is explained only with reference to an operation thereof, as in the case of the above fifth embodiment.

In this sixth embodiment, the high voltage source is being turned ON during the cleaning sequence, so that the charges are applied to the belt before the pre-charging is effected. In this way, the predetermined time period $t_4$ in the pre-charging can be shortened, thus providing an advantage that the total operation time can be reduced.

As mentioned above, while the present invention was explained on the basis of the embodiments thereof, only the pre-charging before the initiation of the conveyance of the recording paper or only the cleaning operation may be adopted, thus improving the conveying ability of the recording paper.

The present invention is particularly suitably usable in an ink jet recording head and recording apparatus. This is because, the high density of the picture element, and the high resolution of the recording are possible.

The typical structure and the operational principle are preferably those disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in, Japanese Laid-Open Patent Application No. 123670 wherein a common slit is used as the ejection outlet for plural electrothermal transducers, and to the structure disclosed in Japanese Laid-Open Patent Application No. 59-138461 wherein an opening for absorbing pressure waves of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

Further, it is preferable that a recovery means for the recording head and preliminary additional means are provided as constructional elements in the recording apparatus because the advantages obtainable by the present invention can be further stabilized. Concretely, such additional means include a capping means for the recording head, cleaning means, pressurizing or attracting means, and preliminary heating means comprising electrical/thermal converters or other heating elements or the combination thereof. Further, a preliminary ink discharge mode for discharging ink without recording the image is also effective to obtain the stable recording.

In addition, regarding the type and/or number of the recording heads mounted on the recording apparatus, only one recording head may be provided for the monocolor recording operation or a plurality of recording heads may be provided for the plurality of inks having different colors and/or different density.

Furthermore, the ink jet recording apparatus according to the present invention is applicable to an equipment used as a terminal image outputting system of an information treating apparatus such as a computer, a copying machine combined with a reader, and a facsimile having the transmission and reception function.

What is claimed is:

1. A recording apparatus comprising:

conveying means rotatable in a predetermined direction for conveying a sheet by holding the sheet in a predetermined area;

recording means for recording an image by discharging ink onto the sheet conveyed by said conveying means;

cleaning means for contacting said conveying means at an area other than the predetermined area where said conveying means holds the sheet, said cleaning means sweeping the ink adhered to said conveying means by slidingly contacting therewith, said cleaning means being shiftable with respect to said conveying means, between an engagement position where said cleaning means is engaged by said conveying means and a disengagement position where said cleaning means is separated from said conveying means; and an absorbing member for absorbing the ink adhered to said conveying means, said absorbing member being disposed at a position other than said predetermined area and in a downstream side of said cleaning means with respect to the predetermined direction of rotation of said conveying means.

2. A recording apparatus according to claim 1, wherein said conveying means comprises a belt rotatable to convey the sheet by contacting the sheet.

3. A recording apparatus according to claim 1, wherein said recording means records the image with ink droplets formed by thermal energy.

4. A recording apparatus according to claim 1, wherein cleaning means includes a plate-shaped member and performs a cleaning operation by abutting an end of said plate-shaped member against said conveying means.

5. A recording apparatus according to claim 4, wherein said plate-shaped member is made of rubber.

6. A recording apparatus according to claim 1, wherein said absorbing member absorbs the ink by a capillary phenomenon.

7. A recording apparatus according to claim 1, wherein said absorbing member is made of sponge material.

8. A recording apparatus according to claim 1, wherein said absorbing member is shiftable with respect to said conveying means, between an engagement position where said absorbing member is engaged by said conveying means and a disengagement position where said absorbing member is separated from said conveying means.

9. A recording apparatus comprising:

conveying means rotatable in a predetermined direction for conveying a sheet by holding the sheet in a predetermined area;

recording means for recording an image by discharging ink onto the sheet conveyed by said conveying means;

cleaning means for contacting said conveying means at an area other than the predetermined area where said conveying means holds the sheet, said cleaning means sweeping the ink adhered to said conveying means by slidingly contacting therewith; and an absorbing member for absorbing the ink adhered to said conveying means, said absorbing member being disposed at a position other than said predetermined area and in a downstream side of said cleaning means with respect to the predetermined direction of rotation of said conveying means, said absorbing member being shiftable with respect to said conveying means, between an engagement position where said absorbing member is engaged by said conveying means and a disengagement position where said absorbing member is separated from said conveying means.

10. A recording apparatus according to claim 9, wherein said conveying means comprises a belt rotatable to convey the sheet by contacting the sheet.

11. A recording apparatus according to claim 9, wherein said recording means records the image with ink droplets formed by thermal energy.

12. A recording apparatus according to claim 9, wherein said cleaning means includes a plate-shaped member and performs a cleaning operation by abutting an end of said plate-shaped member against said conveying means.

13. A recording apparatus according to claim 12, wherein said plate-shaped member is made of rubber.

14. A recording apparatus according to claim 9, wherein said absorbing member absorbs the ink by a capillary phenomenon.

15. A recording apparatus according to claim 9, wherein said absorbing member is made of sponge material.

16. A recording apparatus comprising:

conveying means for conveying a sheet by contacting therewith;

recording means for recording an image onto the sheet conveyed by said conveying means;

cleaning means for cleaning said conveying means;

shifting means for shifting said cleaning means between a first position where said cleaning means cleans said conveying means and a second position where said cleaning means does not clean said conveying means; and controlling means for controlling said shifting means so that said shifting means shifts said cleaning means in the second position when recording is effected by said recording means.

17. A recording apparatus according to claim 16, wherein said conveying means comprises a belt shiftable to convey the sheet while contacting the sheet.

18. A recording apparatus according to claim 16, wherein said recording means records the image with ink droplets formed by thermal energy.

19. A recording apparatus according to claim 16, wherein said cleaning means includes a plate-shaped member and performs a cleaning operation by abutting an end of said plate-shaped member against said conveying means.

20. A recording apparatus according to claim 16, wherein said cleaning means is shiftable with respect to said conveying means, between an engagement position where said cleaning means is engaged by said conveying means and a disengagement position where said cleaning means is separated from said conveying means.

21. A recording apparatus according to claim 19, wherein said plate-shaped member is made of rubber.

22. A recording apparatus according to claim 16, wherein said shifting means includes an electro-magnetic actuator.

23. A recording apparatus according to claim 19, wherein said cleaning means includes an absorbing member for absorbing the ink.

24. A recording apparatus according to claim 23, wherein said absorbing member is disposed at a downstream side of said plate-like member in a shifting direction of said belt.

25. A recording apparatus according to claim 23, wherein said absorbing member is shiftable with respect to said conveying means, between an engagement position where said absorbing member is engaged by said conveying means and a disengagement position where said absorbing member is separated from said conveying means.

26. A recording apparatus comprising:

conveying means for conveying a sheet by contacting therewith;

recording means for recording an image onto the sheet conveyed by said conveying means;

cleaning means for sweeping the ink adhered to said conveying means by slidingly contacting therewith;

first shifting means for shifting said cleaning means between a first position where said cleaning means slidingly contacts said conveying means and a second position where said cleaning means is separated from said conveying means;

an absorbing member for absorbing the ink adhered to said conveying means;

second shifting means for shifting said absorbing member between a first position where said absorbing member slidingly contacts said conveying means and a second position where said absorbing member is separated from said conveying means;

control means for controlling said conveying means, said first shifting means and said second shifting means in such a manner that said cleaning means is separated from said conveying means after said conveying means is actuated with said cleaning means slidingly contacting said conveying means and the ink adhered to an area of said conveying means where said cleaning means has been in sliding contact is then absorbed by said absorbing member.

27. A recording apparatus according to claim 26, wherein said control means urges said cleaning means against said conveying means after the operation of a reset switch, activates said conveying means to move a predetermined amount, separates said cleaning means from said conveying means, and urges said absorbing member against said conveying means to absorb the ink remaining on said conveying means at and around a position where said cleaning means was urged against said conveying means.

28. A recording apparatus according to claim 27, wherein said conveying means comprises a belt shiftable to convey the sheet while contacting the sheet, and said cleaning means and said absorbing member are urged against a surface of said belt.

29. A recording apparatus according to claim 28, wherein said recording means records the image with ink droplets formed by thermal energy.

30. A recording apparatus according to claim 29, wherein said absorbing member is disposed at a downstream side of said cleaning means in a shifting direction of said belt.

31. A recording apparatus according to claim 30, wherein said cleaning means includes a plate-shaped member and performs a cleaning operation by abutting an end of said plate-shaped member against said conveying means.

32. A recording apparatus according to claim 31, wherein said plate-shaped member is made of rubber.

33. A recording apparatus according to claim 32, wherein said absorbing member absorbs the ink by a capillary phenomenon.

34. A recording apparatus according to claim 33, wherein said absorbing member is made of sponge material.

35. A recording apparatus according to claim 34, wherein said first shifting means includes an electromagnetic actuator.

36. A recording apparatus according to claim 35, wherein said second shifting means includes an electromagnetic actuator.

37. A recording apparatus according to claim 26, further including a feeding path through which the sheet conveyed by said conveying means can pass; and wherein a detecting means detects an abnormality in conveyance when a time period required for conveying the sheet for a predetermined distance in said feeding path exceeds a predetermined time period.

38. A recording apparatus according to claim 26, wherein said recording means records the image with ink droplets formed by thermal energy.

39. An image forming system comprising:

sheet conveying means having a contact surface for contacting a sheet and adapted to convey the sheet by moving said conveying means while said contact surface is in contact with the sheet;

charging means for charging said contact surface to adhere the sheet to said contact surface;

recording means for recording an image on the sheet conveyed by said conveying means; and control means for controlling said charging means to charge said contact surface, wherein a portion of the contact surface, after passing by said charging means once, passes by said charging means once again before said contact surface and the sheet to be conveyed come into contact.

40. An image recording apparatus according to claim 39, wherein said charging means comprises a charging roller.

41. An image recording apparatus according to claim 40, wherein said charging means is arranged in a fixed position, and said control means controls the shifting of said contact surface to pass all of said contact surface through said charging means at least twice before said contact surface and the sheet to be conveyed come into contact.

42. An image recording apparatus according to claim 39, wherein said conveying means comprises an endless belt on a surface of which said contact surface is formed, and said charging means is disposed at a position along a run of said endless belt.

43. An image recording apparatus according to claim 42, further including a second conveying means for conveying the sheet to said first-mentioned conveying means at a timing so as to contact the sheet with a portion of said contact surface which has passed through said charging means at least twice.

44. A recording apparatus according to claim 42, further comprising an absorbing member, wherein said absorbing member absorbs ink from the surface of said endless belt by a capillary phenomenon.

45. A recording apparatus according to claim 44, wherein said absorbing member is made of sponge material.

* * * * *

UNITED STATES PATENT AND TRADEMARK OFFICE

CERTIFICATE OF CORRECTION

PATENT NO. : 5,225,853 Page 1 of 2

DATED : July 6, 1993

INVENTOR(S) : Tohru KOBAYASHI, et al.

It is certified that error appears in the above-indentified patent and that said Letters Patent is hereby corrected as shown below:

On title page,

[56] REFERENCES CITED - FOREIGN PATENT DOCUMENTS

"59-123760 7/1984 Japan ." should be deleted.

COLUMN 2:

Line 38, "constructual" should read --constructional--.

COLUMN 3:

Line 25, "an" should be deleted.

COLUMN 6:

Line 7, "material" should read --coating material--;

Line 13, "more high" should read --higher--;

Line 25, "a" should read --an--;

Line 27, "FIG. 4," should read --FIG. 4--;

Line 33, "abnormity" should read --abnormality--.

UNITED STATES PATENT AND TRADEMARK OFFICE

CERTIFICATE OF CORRECTION

PATENT NO. : 5,225,853 Page 2 of 2

DATED : July 6, 1993

INVENTOR(S) : Tohru KOBAYASHI, et al.

It is certified that error appears in the above-indentified patent and that said Letters Patent is hereby corrected as shown below:

COLUMN 7:

Line 60, "periods" should read --period--.

COLUMN 14:

Line 30, "system particularly" should read --system. Particularly,--;

Line 37, "provide" should read --provided--;

Line 59, "in," should read --in--.

COLUMN 16:

Line 2, "cleaning" should read --said cleaning--.

Signed and Sealed this

Third Day of May, 1994

Bruce Lehman

*Attest:*

BRUCE LEHMAN

*Commissioner of Patents and Trademarks*

*Attesting Officer*